United States Patent [19]

Elizondo

[11] Patent Number: 4,546,981

[45] Date of Patent: Oct. 15, 1985

[54] CHECKER OR CHESS GAME BOARD WITH ROTATABLE STRIPS

[76] Inventor: Roberto S. Elizondo, 207 Red Oak, Texas City, Tex. 77590

[21] Appl. No.: 570,819

[22] Filed: Jan. 16, 1984

[51] Int. Cl.[4] ..... A63F 3/02

[52] U.S. Cl. ..... 273/260; 273/284

[58] Field of Search ..... 273/260, 280, 282, 287, 273/283, 284; 434/174, 402, 404; 40/503, 504, 505, 506

[56] References Cited

U.S. PATENT DOCUMENTS

| | | | |
|---|---|---|---|
| 1,038,062 | 9/1912 | Albert | 273/282 X |
| 1,068,609 | 7/1913 | Toppi | 40/504 |
| 4,022,473 | 5/1977 | Foley | 273/280 X |
| 4,216,964 | 8/1980 | Gans | 273/282 X |

FOREIGN PATENT DOCUMENTS

| | | | |
|---|---|---|---|
| 256000 | 7/1948 | Switzerland | 273/284 |

*Primary Examiner*—Richard C. Pinkham
*Assistant Examiner*—Scott L. Brown
*Attorney, Agent, or Firm*—Neal J. Mosely

[57] ABSTRACT

A novel chess or checker game board has a playing field comprising a series of adjacent rotatable strips each of which bears a row of alternatively colored spaces on the top and bottom surfaces. The strips of the board have an initial position in which the spaces thereon form a bilaterally colored pattern corresponding to a checker or chess board. The strips and playing pieces are provided with cooperable releasable attaching structure to secure the pieces thereon. Each player may move a piece in the manner of a normal checker or chess game or may rotate a strip 180° before a playing piece is moved so that the relationship of the playing pieces on the board row are changed from the relationship produced by the previous move of the opposing player, thus providing a novel, challenging and interesting game having continuously changing situations between the game playing pieces.

22 Claims, 8 Drawing Figures

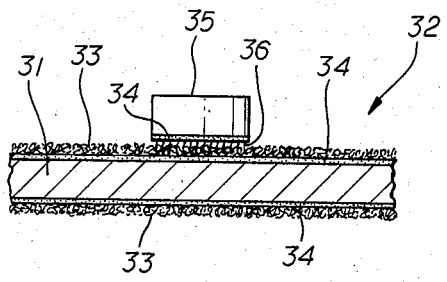
fig.5
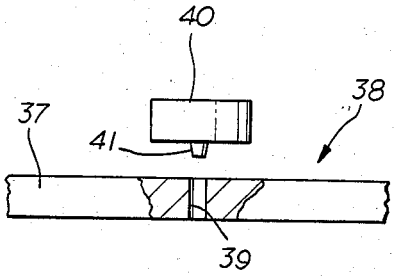
fig.6
fig.7
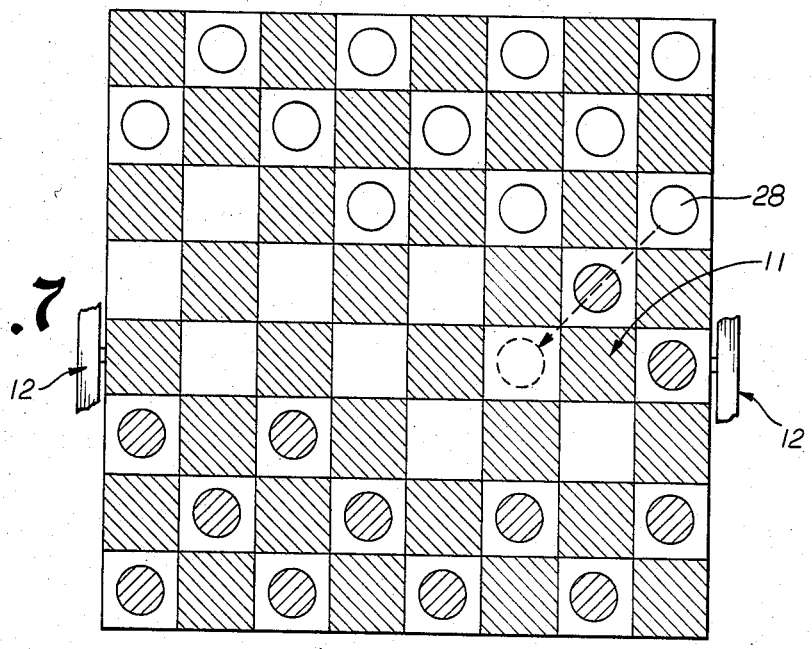
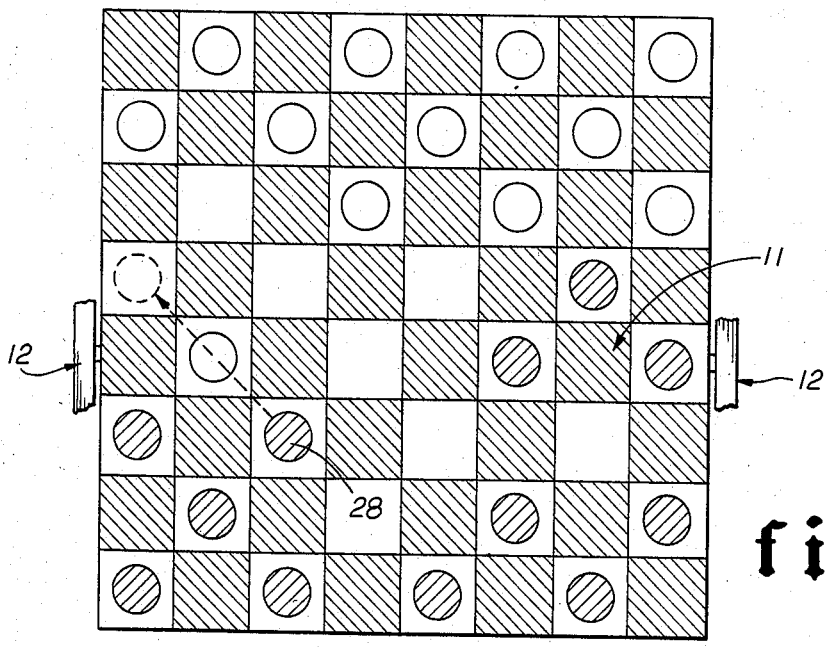
fig.8

CHECKER OR CHESS GAME BOARD WITH ROTATABLE STRIPS

BACKGROUND OF THE INVENTION

1. Field of the Invention

This invention relates to game boards, and more particularly to a game board of the chess or checker type having a plurality of bilaterally colored alternating squares and having a novel means to vary the relationship of the playing pieces in addition to the normal moves made according to the rules of the game.

2. Brief Description of the Prior Art

There are several patents which disclose game boards of the checker and chess variety and some which disclose game boards having movable playing fields.

Brown, U.S. Pat. No. 1,605,703 discloses a magnetic checker game having a fixed playing field.

Marcil, U.S. Pat. No. 4,005,866 discloses another magnetic game having a fixed playing field.

Lemkin, U.S. Pat. No. 3,799,548 discloses a magnetic game having magnetic playing pieces, and a fixed non-magnetic game board.

Ekbom, U.S. Pat. No. 1,955,795 discloses a game board comprising a number of bars or strips made up of squares of dissimilar values which can be shuffled before being bolted together to form a board. The bars or strips may also be held rigidly in place, after assembly, by a frame.

Ardis, U.S. Pat. No. 3,178,185 discloses a game structure with individually rotatable blocks wherein the blocks are provided with one normally hidden face which is to contain a picture thereon with the pictures being in pairs, the object of the game being to match the pairs by selective rotation of two of the blocks.

Sander, U.S. Pat. No. 3,804,418 discloses a checkerboard type game wherein the checkerboard is arranged in strips that can be moved lengthwise on endless belts.

The prior art in general, and none of these patents in particular, disclose a chess or checker game board having adjacent rows of alternatively colored spaces on the top and bottom surfaces which are rotatable to change the relationship of the playing pieces thereon.

SUMMARY OF THE INVENTION

It is therefore an object of the present invention to provide a chess or checker game board having a playing field made of rotatable strips whereby rotation thereof presents a different situation of the playing pieces with each player's move.

Another object of this invention is to provide a chess or checker game board having a playing field comprising rotatable strips having their longitudinal side edges adjacent each other whereby any strip may be rotated 180° to reposition the playing pieces on the strip relative to the playing pieces on the rest of the playing field.

Another object of this invention is to provide a chess or checker game board comprising rotatable strips in which each strip has a row of alternatively colored spaces on the top and bottom surfaces thereof.

Another object of this invention is to provide a chess or checker game board having rotatable strips wherein the strips and playing pieces are provided with cooperable, releasable attaching means to secure the playing pieces thereon.

Another object of this invention is to provide a novel, interesting and challenging game having continuously changing situations between the playing pieces.

Other objects of the invention will become apparent from time to time throughout the specification and claims as hereinafter related.

The above noted objects and other objects of the invention are accomplished by a game board having a playing field comprising a series of adjacent rotatable strips each of which bears a row of alternately colored spaces on the top and bottom surfaces. The strips of said board have an initial position in which the spaces thereon form a bilaterally colored pattern corresponding to a checker or chess board. The strips and playing pieces are provided with cooperable releasable attaching means to secure the pieces thereon. Each player may move a piece in the manner of a normal checker or chess game or may rotate a strip 1b 180° before a playing piece is moved so that the relationship of the playing pieces on the board row are changed from the relationship produced by the previous move of the opposing player, thus providing a novel, challenging and interesting game having continuously changing situations between the game playing pieces.

BRIEF DESCRIPTION OF THE DRAWINGS

FIG. 5 is a partial cross sectional view of an alternate embodiment of the rotatable strips in accordance with the present invention.

FIG. 6 is a partial cross sectional view of another alternate embodiment of the rotatable strips in accordance with the present invention.

FIG. 7 is a top plan view of the playing field showing a situation of the playing pieces prior to a particular strip being rotated.

FIG. 8 is a top plan view of the playing field showing a situation of the playing pieces after a particular strip has been rotated.

DESCRIPTION OF THE PREFERRED EMBODIMENT

Figure 1:
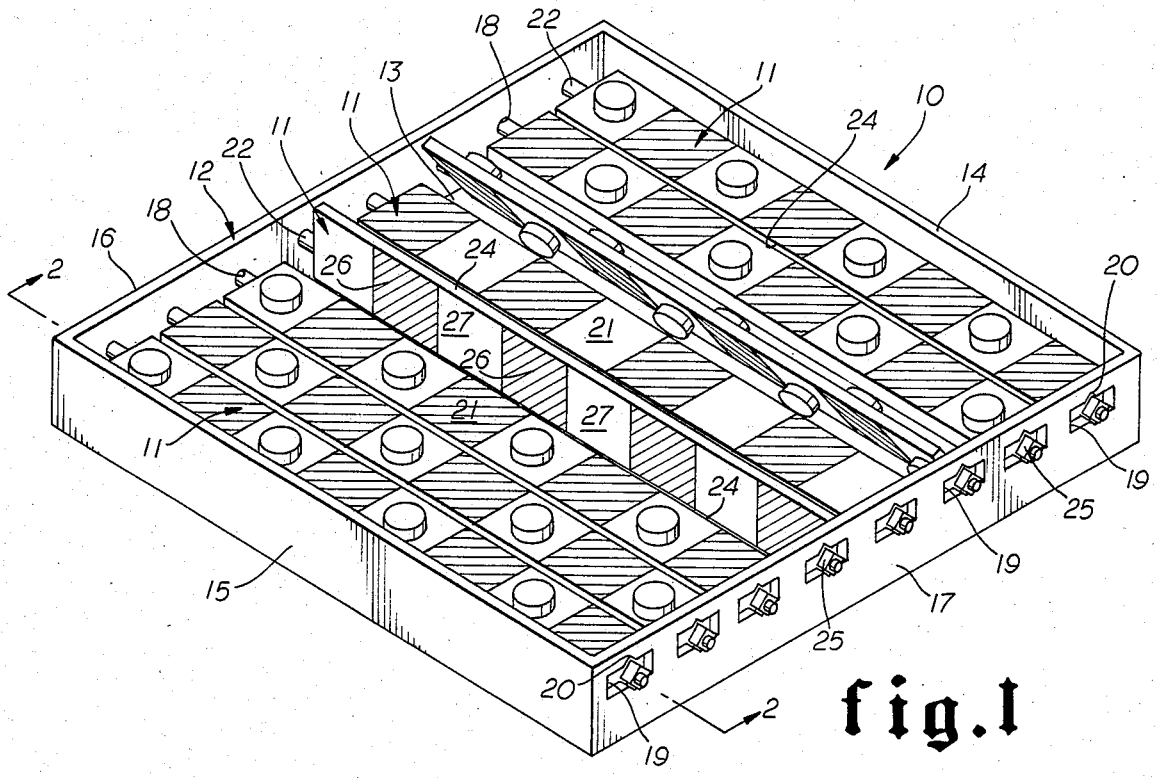
FIG. 1 is an isometric view of the game board in accordance with the present invention.
Figure 2:
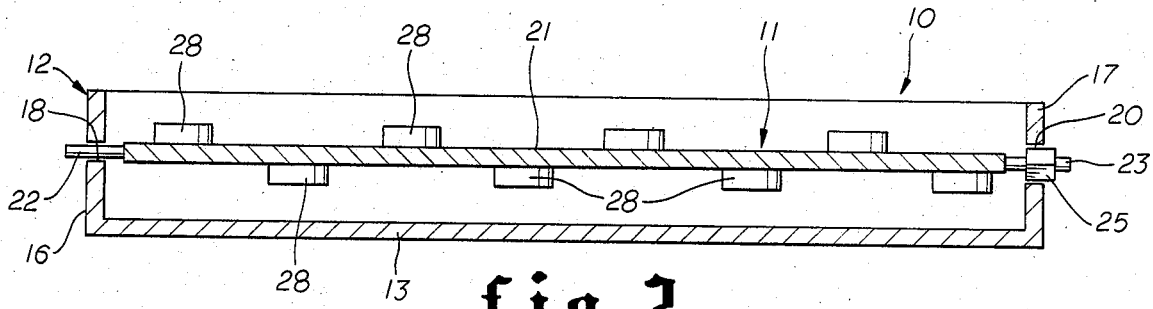
FIG. 2 is a side view in cross section taken along the section line 2—2 of FIG. 1.
Figure 3:
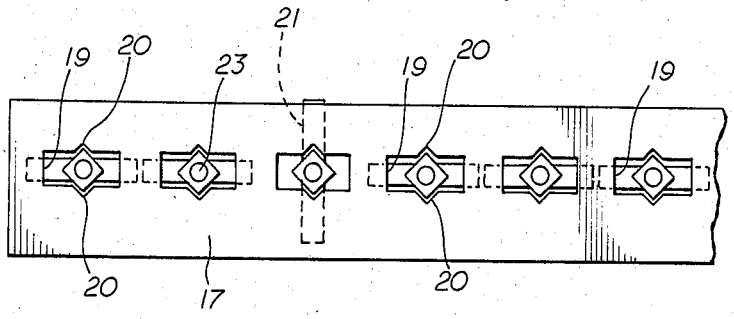
FIG. 3 is a partial side view of one side of the game board.

Referring to the drawings by numerals of reference, and more particularly to FIGS. 1, 2, and 3, there is shown a chess or checker game board 10 with rotatable strips 11 illustrating a preferred embodiment of this invention. The game board comprises a box-like frame member 12 having a flat planar bottom wall 13 (the bottom may be open if desired), and vertical side walls 14, 15, 16, and 17. Side wall 16 is provided with a series of laterally spaced holes 18, while side wall 17 is provided with a series of laterally spaced slots 19 axially aligned therewith. Each of the slots 19 has a central triangular notch portion 20 extending above and below the width of the slot 19.

Each of the rotatable strips 11 comprises a flat planar rectangular board member 21, the opposing ends of which are provided with rods 22 and 23 extending outwardly therefrom. The longitudinal side edges 24 of the strips 11 are positioned closely adjacent each other with only sufficient clearance to permit rotation of the strips.

The rods 22 extending from one end of the strips 11 are sized to fit the holes 18, and extend outwardly therefrom.

A square knob 25 is provided on each of the rods 23 extending from the opposing end of the strips 11. Knob 25 is of suitable size and shape to fit in the notch portions 20 of the slots 19 and extend outwardly therefrom sufficient to grasp with the fingertips. The length of the rectangular portion 21, the rods 22 and 23, and the knobs 25 is such that each of the knobs 25 may be pulled laterally out of contact with the notch 20 and rotated 180° while the rod 22 at the opposing end remains in sliding engagement with the hole 18.

The top and bottom surfaces of the rectangular board members 21 are each provided with an identical row of alternatively spaced bilaterally colored spaces 26 and 27. The board members 21 comprising adjacent strips 11 have the same color scheme but diagonally offset from the strip next to it to form a checkerboard pattern. Thus, there are provided two identical fields, one on the top surface and one on the bottom surface of the strips.

The game is played with two complete sets of playing pieces 28 to occupy both playing fields. Playing pieces 28 are shown as checkers and the game is illustrated for the game of checkers. When a game of chess is to be played, checker-shaped pieces are used which bear the indicia of the various chess pieces, to allow sufficient clearance for the playing strips 11 to be rotated. The playing pieces and the board have cooperable means to secure the pieces in place during rotation of the strips 11.

Figure 4:
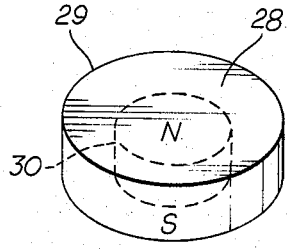
FIG. 4 is an isometric view of a typical playing piece of the present invention.

In one embodiment of the invention, the rectangular board members 21 supporting the strips 11 is composed of magnetic material, e.g. iron, steel, etc. properties, and the playing pieces 28 are magnetic. FIG. 4 shows a typical playing piece 28. The playing piece 28 comprises a small disk 29 having a magnet 30 therein to secure the same on the board during play and particularly when the strips 11 are rotated 180° as permitted by the rules of the game. It should be understood that the playing pieces 28 may be of other shapes or otherwise bear colors or symbols suitable for the playing of checkers or chess or other games using a checkerboard.

FIG. 5 shows another embodiment of the game board with rotatable strips wherein the top and bottom surfaces of the rectangular portion 31 of the strips 32 comprise one part of a fabric fastener 33 such as Velcro (a trademark of the Dow Chemical Company) fastened thereto by a suitable adhesive 34, and the playing piece 35 has the mating part 36 of of the fabric fastener attached to the bottom surface by adhesive 34.

FIG. 6 shows another embodiment of the game board wherein the top and bottom surfaces of the rectangular portion 37 of the strips 38 are provided with a hole 39 therethrough located in the center of the spaces and the bottom of the playing piece 40 is provided with a downwardly extending peg 41 sized to provide a friction fit in the hole 39. This means for securing the playing pieces can also be reversed, i.e. the hole 39 may be in the playing piece 40 and the pegs 41 extend from opposite sides of the strips 11 from the center of each colored square thereon.

OPERATION

Referring now to FIGS. 1, 7, and 8, the game action will be explained. The game board is suitable for use with all types of games using a playing field of bilaterally colored squares or spaces to be occupied by playing pieces, e.g. a checker- or chess-type game. The arrangement and type of pieces used and the rules of the game may be selected, as desired, to provide and interesting game.

In a typical game, the playing pieces are set up as in normal play, of checker or of chess, on both the top and bottom playing fields. Rules of the particular game being played are followed with the exception that before each player makes a move, he must (or may) grasp the knob and pull it outwardly from the frame, turn it 180° and then push it inwardly, thus exposing the reverse playing surface and the piece(s) positioned thereon. The game becomes more interesting and challenging because by rotating the strips each time, a situation is created which was different from the one encountered or created by the opposing player.

While any suitable rules may be devised for the game, the rules discussed herein have proved to provide a challenging and interesting game. The strips may be rotated as either an offensive or defensive tactic. Should one player forget to rotate a strip before his move, the other player is allowed to rotate a strip to his own advantage. Jumping or capturing an opponents piece is not allowed without first rotating a strip. If a player has no pieces showing on the current playing side, he must rotate additional strips of the board until he finds one. The last playing piece of one player cannot be rotated to avoid a move. The game will end according to the normal game rules, a stalemate situation exists, or until one player has no more playing pieces.

FIGS. 7 and 8 illustrate a typical situation in a checker type game. FIG. 7 shows the playing pieces at a point in the game wherein the player of the light colored pieces has an advantage over the other. FIG. 8 shows the playing pieces after the opposing player represented by the dark colored pieces has rotated one of the strips 11. As can be seen, he has successfully put himself out of jeopardy and is now in a position to capture the opponent's playing piece.

While this invention has been described fully and completely with special emphasis upon several preferred embodiments, it should be understood that within the scope of the appended claims the invention may be practiced otherwise than as specifically described herein.

I claim:

1. A chess- or checker-like board game comprising a game board of thin sheet material having an array of rows and columns of bilaterally colored squares on opposite surfaces thereof, said game board being divided into a plurality of separate strips of said sheet material, each of said strips comprising a complete row or column of said board and spaced adjacent to each other to form the pattern of a chess- or checkerboard, each of said strips being divided into a plurality of alternating squares, bilaterally colored and having the same pattern on top and bottom sides so that rotation of said strips does not change the pattern of the board, means supporting each of said strips for rotation between a first position with one surface exposed upward and a second position with the other surface exposed upward, and means for securing each strip in said first or said second position, said game board being adapted for play with a plurality of playing pieces selectively movable on said board and releasably held on said strips during rotation thereof.

2. A chess- or checker-like board game according to claim 1 including a plurality of playing pieces adapted to be moved selectively on said board, and means operable to hold said playing pieces releasably on said strips during rotation thereof.

3. A chess- or checker-like board game according to claim 2 in which said playing piece holding means comprises playing board strips of magnetic material and playing pieces having magnetic attachment means thereon.

4. A chess- or checker-like board game according to claim 2 in which said playing piece holding means comprises playing board strips having top and bottom surfaces of a fabric fastener and said playing pieces having the mating part of said fabric fastener.

5. A chess- or checker-like board game according to claim 2 in which said playing pieces are checkers.

6. A chess- or checker-like board game according to claim 2 in which said playing pieces are chessmen.

7. A chess- or checker-like board game according to claim 1 including a supporting frame for said game board in which said strips are supported for rotation.

8. A chess- or checker-like board game according to claim 7 in which said supporting frame is square and includes supporting means on opposite sides thereof supporting said board strips for rotation.

9. A chess- or checker-like board game according to claim 8 in which said frame comprises four vertically oriented side wall members joined at the ends in a square, one of said wall members having a series of longitudinally spaced holes and the opposite side wall having a series of longitudinally spaced openings axially aligned said holes, each of said strips having a cylindrical supporting abutment at one end fitting said holes to support the same for rotary movement and having means at the other end extending through said openings for supporting and turning said strips, and said strip securing means being cooperable with said strip turning means for securing said strips in a selected position.

10. A chess- or checker-like board game according to claim 9 in which said strip turning means comprises a knob member extending through said opening, and each of said openings includes means cooperable with said knob members for securing said strips in a selected position.

11. A chess- or checker-like board game according to claim 10 in which said frame openings comprise slots having a central triangular notch portion extending above and below the width of said slot and defining a square opening, and said knob members being square and fitting said square openings to secure said strips in position.

12. A chess- or checker-like board game according to claim 10 in which each of said rotatable strips has a rod portion extending outwardly from one of the ends thereof, said first rod portion of sufficient diameter to be slidably and rotatably received within said holes and extend outwardly therefrom, a second rod portion extending outwardly from the opposing end of each strip having a square knob, said knob being adapted to be slidably received in said square opening in said slots and extend outwardly therefrom sufficient to grasp with the fingertips, and said strips, rods, and knob having a selected length whereby said knob may be pulled out of contact with said square opening and rotated 180° while the rod at the opposing end remains in said hole.

13. A chess- or checker-like board game according to claim 1 in which said playing piece holding means comprises a system of holes in one part and retaining pegs in the other part.

14. A chess- or checker-like board game according to claim 13 in which said holes are in said game board strips and said pegs are in said playing pieces.

15. A chess- or checker-like board game according to claim 13 in which said holes are in said playing pieces and said pegs are in said game board strips.

16. A chess- or checker-like board game according to claim 1 including a plurality of playing pieces adapted to be moved selectively on said board, means operable to hold said playing pieces releasably on said strips during rotation thereof, and in which each of said strips is divided into a plurality of alternating squares, bilaterally colored and having the same pattern on top and bottom sides so that rotation of said strips does not change the checkerboard pattern of the board.

17. A chess- or checker-like board game according to claim 16 including a supporting frame for said game board in which said strips are supported for rotation.

18. A chess- or checker-like board game according to claim 17 in which said supporting frame is square and includes supporting means on opposite sides thereof supporting said board strips for rotation.

19. A chess- or checker-like board game according to claim 18 in which said frame comprises four vertically oriented side wall members joined at their ends in the form of a square, one of said wall members having a series of longitudinally spaced holes and the opposite side wall having a series of longitudinally spaced openings axially aligned said holes, each of said strips having a cylindrical supporting abutment at one end fitting said holes to support the same for rotary movement and having means at the other end extending through said openings for supporting and turning said strips, and said strip securing means being cooperable with said strip turning means for securing said strips in a selected position.

20. A chess- or checker-like board game according to claim 19 in which said strip turning means comprises a knob member extending through said opening, and each of said openings includes means cooperable with said knob members for securing said strips in a selected position.

21. A chess- or checker-like board game according to claim 20 in which said frame openings comprise slots having a central triangular notch portion extending above and below the width of said slot and defining a square opening, and said knob members being square and fitting said square openings to secure said strips in selected positions.

22. A chess- or checker-like board game according to claim 20 in which each of said rotatable strips has a rod portion extending outwardly from one of the ends thereof, said first rod portion of sufficient diameter to be slidably and rotatably received within said holes and extend outwardly therefrom, a second rod portion extending outwardly from the opposing end of each strip having a square knob, said knob being adapted to be slidably received in said square opening in said slots and extend outwardly therefrom sufficient to grasp with the fingertips, and said strips, rods, and knob having a predetermined length whereby said knob may be pulled laterally out of contact with said square opening and rotated 180° while the rod at the opposing end remains in said hole.

* * * * *